United States Patent [19]

Stockdale et al.

[11] 4,040,234

[45] Aug. 9, 1977

[54] METHOD AND DEVICE FOR RACKING AND SEALING CONTAINERS

[75] Inventors: Douglas P. Stockdale, Anaheim; Richard Mencarini, Hungtington Beach; Carlton D. Deaton, Garden Grove; Ralph M. Owen, Laguna Hills, all of Calif.

[73] Assignee: Baxter Travenol Laboratories, Inc., Deerfield, Ill.

[21] Appl. No.: 649,079

[22] Filed: Jan. 14, 1976

[51] Int. Cl.[2] ..... B67B 5/00; B01L 9/06

[52] U.S. Cl. ..... 53/38; 23/259; 23/292; 206/526; 211/76

[58] Field of Search ..... 23/259, 292, 230 R; 206/820, 427, 526, 72; 215/316, 341; 220/23.2, 23.4, 23.83; 211/74, 76; 53/38

[56] References Cited

U.S. PATENT DOCUMENTS

| | | | |
|---|---|---|---|
| 426,811 | 4/1890 | Henkel | 211/76 |
| 2,582,566 | 1/1952 | Schwimmer et al. | 215/350 X |
| 2,725,782 | 12/1955 | Worley | 211/74 X |
| 2,726,771 | 12/1955 | Cozzoli | 211/74 |
| 3,098,721 | 7/1963 | Jewell | 23/259 |
| 3,142,385 | 7/1964 | Kahlenberg | 211/74 |
| 3,171,561 | 3/1965 | MacLean | 215/341 X |
| 3,272,369 | 9/1966 | Grimsley | 215/341 X |
| 3,302,854 | 2/1967 | Midgley et al. | 220/23.4 X |
| 3,480,400 | 11/1969 | Csizmas et al. | 23/292 X |
| 3,483,997 | 12/1969 | Ritter | 215/316 X |
| 3,778,232 | 12/1973 | McMorrow, Jr. | 211/74 X |
| 3,841,466 | 10/1974 | Hoffman et al. | 206/205 |
| 3,871,832 | 3/1975 | LeBlanc | 23/292 X |
| 3,927,783 | 12/1975 | Bogert | 215/222 |

*Primary Examiner*—Morris O. Wolk
*Assistant Examiner*—Arnold Turk
*Attorney, Agent, or Firm*—Paul C. Flattery; Lawrence W. Flynn; Max D. Hensley

[57] ABSTRACT

A rack assembly comprising mounting means for containers, e.g., test tubes, a lid spaced from said mounting means which cooperates with orifices in the containers, a flexible sealing sheet for sealing the orifices interposed between the lid and mounting means, and means for spacing the lid from the mounting means and for gripping the sealing sheet. Containers are inserted in the mounting means. The sheet is then placed over the containers, and the lid in turn placed over the sheet so that the sheet seals the container orifices as the containers are maintained in substantially fixed position by the mounting means. By agitating the rack assembly the containers held therein are also shaken. The rack assembly is easily re-used by stripping off and discarding the sealing sheet.

22 Claims, 8 Drawing Figures

METHOD AND DEVICE FOR RACKING AND SEALING CONTAINERS

BACKGROUND OF THE INVENTION

This invention broadly relates to racks for simultaneously spacing, holding and sealing a plurality of containers and to a method for using said racks to seal the containers and agitate the contents of the sealed containers. Specifically, it relates to racks having a base for supporting the containers, at least one means for aligning the containers in a substantially uniform spaced relationship, a lid for sealing the orifices in the aligned containers and an assembly or clamping system for forcing the lid down upon the container openings as well as maintaining in fixed relationship the base and means for aligning the containers. In one specific embodiment, it relates to test tube racks having a base for the test tubes, perforated plates substantially parallel to the base and spaced above the base to space the test tubes and hold them upright, a lid having a portion which fits over, onto, into, or in other cooperative relationship with the test tube openings, a flexible sealing sheet disposed between the lid and the test tube orifices to seal them, and a device for clamping the lid and sealing sheet into place over the test tubes. Still more specifically, this invention relates to the structure employed to seal the openings of the test tubes, and to the method of sealing involved therein.

U.S. Pat. No. 2,725,782 discloses a test tube rack having a hinged top that swings down over a racked row of test tubes and is then latched in place. The underside of the top is lined with a flat sheet of sealing material. Other patents of interest in this connection disclose a test tube rack having a lid with caps attached (U.S. Pat. No. 3,483,997) or stoppers attached (U.S. Pat. Nos. 3,098,721 and 3,752,651).

Threaded or snap-on single container caps having resilient seals are known. U.S. Pat. Nos. 2,582,666, 3,219,222 and 3,272,369 all disclose threaded caps having resilient portions which deform in conformance to the lip of the container and thus effect a seal. U.S. Pat. No. 3,896,959 discloses a foam-backed resilient seal for a snap-on container cap.

U.S. Pat. No. 3,682,323 teaches the use of axially flanged or grooved cylinders for spacing the component plates in a test tube rack.

In various chemical processes, particularly analytical procedures, a large number of batch reactions are desirably performed simultaneously with a minimum of manipulative steps. Such steps generally entail either mixing or suspension of materials, or both. It is important to perform the mixing or suspension step without leakage of container contents while ensuring rapid and complete mixing or suspension. Furthermore, it is often desired to perform the step using the container in which the remainder of the process occurs. Hence test tube or reaction container racks are needed which allow the technician to seal a plurality of containers simultaneously and then agitate the whole structure until suitable mixing or suspension has been achieved. Further, when the rack and lid are to be reused it is imperative that the device provide for a rapid exchange of containers and seals without incurring cross-contamination or the necessity of washing any of the rack components.

The prior art has failed to satisfy the foregoing requirements. The known test tube racks do not provide for ready reuse in that no provision is made for providing a renewable sealing surface. Further prior art racks having lids with a flat, rigid-backed sealing material often fail to seal satisfactorily, particularly when employing containers with irregular lips, e.g. disposable test tubes. Lids having protruding caps or stoppers can be time-consuming to align and effectively seal.

Therefore, it is a general object of this invention to provide a rack for holding a plurality of containers such as disposable test tubes, and for rapidly and effectively sealing the containers.

It is a further object of the invention to provide a rack having a lid for sealing a plurality of containers held in the rack, the rack being constructed for the rapid renewal or replacement of a flexible sealing member interposed between the lid and orifices in containers held in the rack.

It is another object of the invention to provide a rack for holding a plurality of containers wherein the container orifices are sealed by stretching and holding a flexible membrane over the openings in the containers.

It is another object of the invention to provide a method using the rack of the invention whereby a plurality of containers can be sealed and agitated.

These and other objects of the invention will be apparent to those skilled in the art from consideration of this specification taken in its entirety.

SUMMARY OF THE INVENTION

The above objects are accomplished by providing a rack for holding and sealing a plurality of containers having orifices, the rack comprising in combination:

a. mounting means for supporting and indexing a plurality of containers in predetermined spaced relationship;

b. a lid opposite the mounting means at least one surface of which has sealing portions adapted to cooperate in a sealing relationship with the orifices in the containers;

c. a flexible sheet for sealing the container orifices, said sheet disposed between the mounting means and sealing portions of the lid;

d. a spacing means for spacing the lid and mounting means at a predetermined distance and for removably fixing the sealing sheet between the lid sealing portions and the mounting means, whereby the sealing portions of the lid cause the flexible sheet to engage the orifices and seal the containers.

The mounting means generally comprises a base for maintaining the bottoms of the containers in the same plane when downward force is exerted on the containers, and an alignment means having holes or sleeves into which the containers are inserted for orientation into a predetermined relationship whereby any substantial side-to-side motion of the container orifices is prevented.

The lid includes a sealing portion which may be a plurality of recesses or apertures. The apertures may be present in protrusions studding the bottom of said lid, they may be formed by ridges present on a planar surface of the lid, or they may simply be holes passing partly or entirely through the lid.

The spacing means is a device such as a clamp, post or slotted wall which will space the lid from the mounting means and also clamp or reversibly maintain the flexible sheet between the lid and the mounting means. This latter function serves to rigidly hold the sheet, particularly the outer portions thereof, in place as it is stretched by the container orifices protruding into the lid sealing portion. The former function serves to limit the degree to which the orifices are permitted to protrude into the sealing portions of the lid. The spacing means may consist of single or multiple elements.

The inventive rack is used in processes where mixing or other agitation of materials in a plurality of containers is desired, although the device is also operative with single containers. The containers, such as test tubes, cuvettes or bottles, serve as receptacles for liquids, solids and suspensions. They have protrusions which include at least one orifice. These materials are conveniently added while the containers rest on the base, held in an upright and indexed position. When the desired materials have been added to the containers, the sealing sheet is placed in position over the container orifices at a point where it can be engaged by the spacing means. The lid is then aligned over the containers so that the sealing portions in the plane of the lid facing the containers coincide with the orifices in the containers, and the spacing means engages the sheet, lid, and mounting means to complete the assembly of the rack. The sheet is then held in place by the spacing means and pulled taut over the container orifices as the orifices are brought into cooperative sealing relationship with the sealing portions of the lid. While this is occurring, the containers abutt the base. Thus, any irregularities in the container orifices are of no moment as the sheet is stretched into conformance with each imperfection in the orifice. The entire device may then be shaken or agitated as desired with no leakage of the containers.

Following agitation the assembling means is disengaged, the lid removed and the sheet stripped off the container orifices. The containers may then be employed as desired, new containers installed in the aligning means, a fresh sealing sheet placed in position and the above procedure repeated. The device therefore provides both for the rapid renewal of the sealing sheet and the convenient, effective and simultaneous closure of the container orifices.

Figure 1:
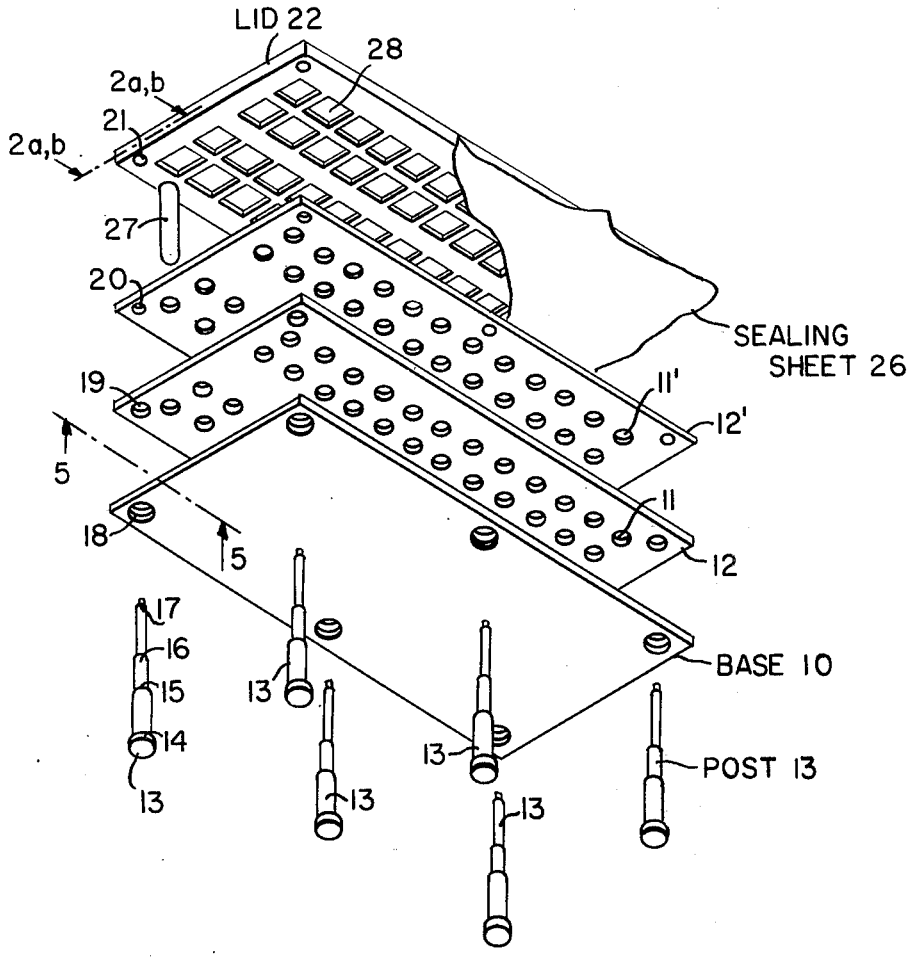
FIG. 1 is an exploded view of a preferred embodiment of the rack assembly of the present invention, with all but one container omitted for clarity of presentation.

FIG. *2a* is an enlarged partial cross-sectional view taken generally along the line *2a* — *2a* of FIG. 1 prior to engagement of the lid and sealing sheet.

FIG. *2b* is an enlarged partial cross-sectional view taken generally along the line *2b* — *2b* of FIG. 1 after engagement of the lid and sealing sheet.

FIGS. *3a* - *3c* are sectional views similar to the right side of FIG. *2a* showing several additional embodiments of the lid sealing portions.

Figure 4:
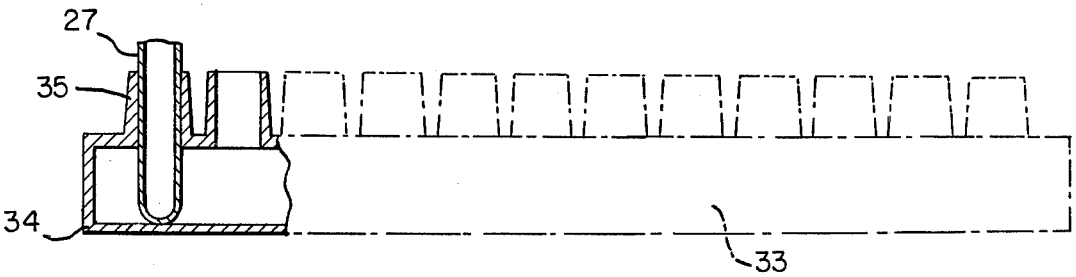

FIG. 4 is a cut-away front view of an additional embodiment of the container mounting means.

Figure 5:
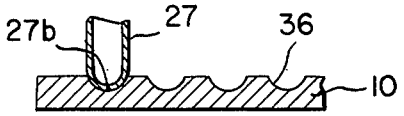
Figure 3A:
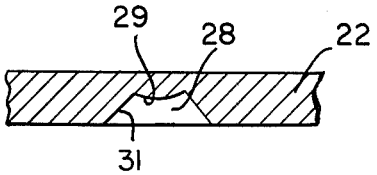
Figure 3B:
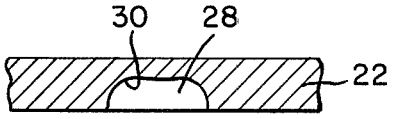

FIG. 5 is a partial cross-sectional view along lines 5 — 5 in FIG. 1.

DESCRIPTION OF THE PREFERRED EMBODIMENTS

A rack assembly for holding and sealing a plurality of containers is shown in FIG. 1. A base 10 supports containers such as test tubes which fit with minimal tolerance through a plurality of alignment holes 11 and 11' in indexing panels 12 and 12'. Panels 12 and 12' are spaced above base 10 and held in place by six posts 13 distributed around the perimeter of the rack assembly. The posts 13 are composed of a series of progressively narrowing shoulders 14, 15, 16 and 17. The shoulders are inserted into corresponding receptacles 18, 19, 20 and 21, respectively, whereby the base 10, panels 12 and 12', and lid 22 are supported upon and spaced by the shoulders 14, 15, 16 and 17, respectively. Thus the rack in the preferred embodiment is assembled by placing the posts 13 through the corresponding receptacle holes in the base 10 and panels 12 and 12'. The device is then ready for insertion of the containers 27 through a plurality of alignment holes 11 and 11'. Following insertion of the containers 27, sealing sheet 26 (shown cut-away in FIG. 1) is placed over the containers. The sheet 26 is then pulled taut as the posts 13 are inserted into receptacle 21 until shoulder 17 abuts the lid 22 and each container 27 protrudes into recessed apertures 28 in lid 22. The sheet 26 is thus firmly held in position and the containers are sealed as the apertures force the sheet 26 into sealing relationship with the orifices *27a* of containers 27, as shown in FIGS. *2a* - *2b*.

The foregoing sequence of assembly is demonstrated in FIGS. *2a* and *2b*. FIG. *2a* illustrates post 13 and container 27 as they advance into the post receptacle 21 and aperture 28, respectively, in lid 22. The sheet 26 may be pulled taut manually or by associated apparatus. However, this is generally not essential because the protrusion of containers 27 into apertures 28 upon assembly serves to pinch the sheet 26 between lid 22 and posts 13 and to deform or stretch sheet 26 between container 27 and the underside of lid 22, thus yielding a highly effective seal. FIG. *2b* shows the device in the sealed mode. Here, sheet 26 is secured to lid 22 by shoulder 17 of post 13 as well as by container 27. As shown in FIG. *2b*, container 27 does not abutt the lid 22 although it does penetrate the aperture 28.

FIGS. *3a* and *3c* illustrate alternative embodiments for the apertures 28 in lid 22. The embodiment of FIG. *3a* is particularly adapted for use with test tubes; the rounded protrusion 29 projects into the mouth of a test tube and thus enhances stretching of the sealing sheet.

FIG. *3b* features an aperture having rounded edges 30 rather than the sharp angles of the substantially square apertures illustrated in FIGS. *2a* and *2b*. These rounded edges, as well as the slanted edge 31 (as shown in FIG. *3a*) serve to guide the container orifice to a central orientation in the aperture 28, thereby obviating any tendency of the orifice to tear the sealing sheet. Some guidance for the container is usually preferred because the containers may wobble slightly in the alignment holes 11 and 11'. These holes are slightly larger than the outer dimensions of the container so as to permit easy insertion and withdrawl from the alignment means. However, even when no guidance to the container is provided the flexibility of the sealing sheet is normally sufficient to effect sealing.

FIG. *3c* shows an additional example of a suitable aperture. Aperture 28 is formed by ridges 32 protruding from the plane of the lid.

FIG. 4 is a mounting means 33 comprising a base portion 34 and upright indexing sleeves 35 formed as a composite single unit instead of as a plurality of members as in the FIG. 1 embodiment (see members 10, 12 and 12' in FIG. 1). The aim here is also to limit wobbling of the containers 27 as much as possible commensurate with ease of container insertion and removal. This is accomplished in FIG. 4 by providing sleeves 35 in place of the holes 11 and 11' in FIG. 1. Moreover, in the FIG. 4 mounting means, the functions of the base and indexing means are combined into a single, integrally manufactured unit. The mounting means 33 may be used with a lid, sheet and posts in a manner similar to that of FIG. 1.

FIG. 5 illustrates the base 10 in partial cross-sectional view through lines 5—5 in FIG. 1. This view shows dish-shaped depressions 36 which cooperate with the base 27*b* of container 27 to aid in firmly indexing the container.

Figure 2A:
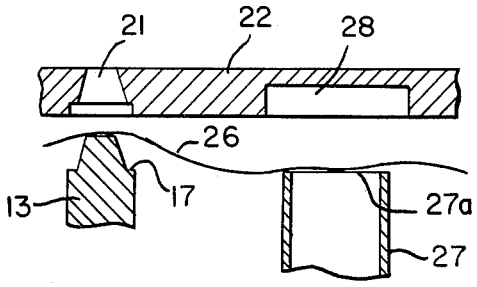
Figure 2B:
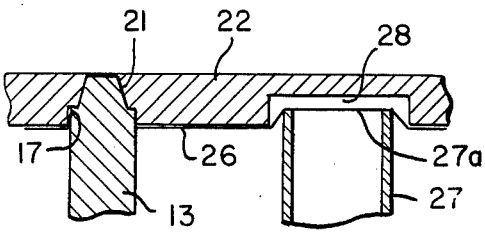
Figure 3C:
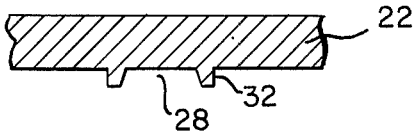

In a preferred embodiment, the height of shoulder 17 is optimized so that lid 22 and base 10 are brought sufficiently close to stretch the sealing sheet 26 over the orifice, but not so close as to bring the container orifice into abutting contact with lid 22 or the aperture 28 of lid 22, as shown in FIG. 2*b*. The invention is intended to encompass both the indirect contact seal just described, as well as one in which the orifice abuts the lid 22 with the sheet 26 acting as a sealing cushion.

The containers of choice for use with the invention are preferably disposable glass test tubes such as those used in performing chemical and biochemical analysis, although the utility of the rack assembly with many other containers will immediately be apparent to those skilled in the art. These test tubes are inexpensive and, being so, are usually made to somewhat liberal tolerances. Further, they are generally small, for example 10mm × 75mm. In a disposable test tube of this size, the length between tubes may vary as much as 3mm while the lip in any one tube may vary as much as 1/32inch. Tubes having tolerances of this nature are readily sealed by the inventive device.

The sealing sheet may be any flexible material capable of stretching into the lid depressions under pressure from the container orifices and which is inert to the process being performed in the containers. Thus the chemical nature of the sheet is of no significance as long as it is non-reactive with the test tube contents. Illustratively, sheets formed of polymeric hydrocarbons such as polyvinyls are satisfactory. Parafilm, a polysheeted paraffin, is an example of one preferred sheet material. The sheet may also have a surface treated to specifically aid in sealing, e.g., an inert adhesive may be applied.

The rack is preferrably constructed of polymeric plastic such as an acrylic resin as these are relatively inexpensive substances and easily worked. Further, they are capable of maintaining a substantially rigid conformation, as is desirable in sealing a plurality of containers. Furthermore, plastics do not abrade glass cuvettes if these are the containers of choice. A plastic having the physical characteristics of methyl methacrylate or polystyrene, including high mechanical strength, rigidity and light weight, is preferred. Other materials, e.g., metals, can, of course, also be used if desired.

The base may be employed to aid in indexing of the containers if the upper surface of the base is scored or milled to conform to the container bases, e.g., as with a dish-shaped depression when test tubes are to be used. Further, the base and alignment means may be integrally molded with the posts or other assembly means to form a unitary body, as described supra. The lid may be hinged or in any other fashion assembled to the remainder of the device. However, the lid should be both rigid and removable for withdrawal and insertion of the sealing sheet. That portion of the spacing means that serves to removably fix the sealing sheet between the lid and mounting means may be located upon the lid as a clamp, screw, plug or other structure for removably afixing the sealing sheet to the lid. The apertures in the lid can also be extended entirely through the lid to form holes so long as the lid remains sufficiently rigid to effect sealing. The lid and the base may include a gripping means such as finger depressions to aid in shaking the rack.

The above preferred embodiments and other specific information contained herein are for purposes of illustration only, and such alterations and modifications thereof as would be apparent to those skilled in the art are deemed to fall within the scope and spirit of the invention, bearing in mind that the invention is defined only by the claims appended hereto.

What is claimed is:

1. Rack for holding and sealing a plurality of containers having orifices, the rack comprising in combination:

a. mounting means for supporting and indexing a plurality of containers in predetermined substantially horizontally spaced relationship;

b. a lid opposite the mounting means at least one rigid surface of which is broken with apertures, each aperture capable of receiving at least one of the orifices;

c. a flexible sheet for sealing the container orifices, said sheet disposed between the mounting means and the lid apertures; and d. a spacing means for spacing the lid and mounting means at a distance predetermined to permit the orifices to penetrate the apertures without abutting the lid, and for removably fixing the sealing sheet between the lid apertures and the mounting means.

2. A rack for holding and sealing a plurality of containers each having a protrusion which includes an orifice, the rack comprising in combination:

a. a base supporting the containers and preventing the passage of containers therethrough;

b. an indexing means communicating with said base for maintaining the containers in predetermined lateral relationship;

c. a lid having at least one rigid surface broken with apertures, each aperture capable of receiving at least one of said protrusions;

d. a flexible sheet for sealing the container orifices, said sheet disposed between the indexing means and lid; and e. spacing means communicating with the lid, base and indexing means for i. orienting the lid apertures so that the apertures receive at least a portion of the container protrusion, and ii. clamping the flexible sheet to the perimeter of the rigid surface of the lid so that the sheet is rigidly clamped in place until becoming freely removable from the lid upon disengagement of the lid and spacing means.

3. The rack of claim 2 wherein the base is a plate.

4. The rack of claim 2 wherein the indexing means is a plate having a plurality of holes adapted to receive the containers.

5. The rack of claim 2 wherein the indexing means comprises a plurality of sleeves for holding the containers upright.

6. The rack of claim 2 wherein the apertures pass entirely through the lid.

7. The rack of claim 2 wherein the flexible sheet is a polysheeted paraffin.

8. The rack of claim 2 wherein the base contains depressions conforming to the container bottoms.

9. The rack of claim 8 wherein the depressions are dish-shaped.

10. The rack of claim 2 wherein the lid comprises a plate having apertures in one side thereof.

11. The rack of claim 10 wherein the apertures have rounded edges.

12. The rack of claim 10 wherein the apertures have slanted edges.

13. The rack of claim 2 wherein the apertures are in rows and the indexing means orients the containers in rows whereby the container orifices are aligned with said apertures.

14. The rack of claim 13 wherein the apertures have slanted edges.

15. The rack of claim 13 wherein the apertures have rounded edges.

16. The rack of claim 2 wherein the spacing means comprises a plurality of posts, each post extending between the base and lid and passing through the indexing means.

17. The rack of claim 16 wherein each post includes at least four shoulders having incrementally increasing diameters from top to bottom and wherein the indexing means comprises two separate holed panels disposed between the base and lid, and wherein the lid, indexing means and base include receptacles for the post shoulders, whereby the posts may be inserted to obtain a rigid assembly.

18. The rack of claim 16 wherein the spacing means comprises six posts.

19. A rack for holding and sealing a plurality of test tubes, the rack comprising in combination:

a. a base having a pattern of dish-shaped depressions on its upper surface;

b. at least one indexing plate above the upper surface of the base having a pattern of holes corresponding to the pattern in the upper surface of said base, each hole for holding a test tube upright;

c. a lid opposite said at least one indexing plate and having one rigid surface broken with substantially square apertures in the same pattern as the holes in said at least one indexing plate;

d. a flexible sheet for sealing the test tubes, said sheet disposed between said at least one indexing plate and the lid; and e. a plurality of posts having shoulders of incrementally decreasing diameter joining the perimeters of said base, said at least one indexing plate, said lid and said flexible sheet, for 1. spacing the base, the indexing plate and the lid; and 2. clamping the flexible sheet only between the upper post shoulders and the perimeter of the lid so that the sheet is freely removable upon disengagement of the lid and posts.

20. The rack of claim 19 wherein the holes in the indexing plate are sufficiently large to permit the tubes to wobble.

21. The process for simultaneously sealing a plurality of containers, each of which includes an orifice, comprising, a. placing a plurality of containers in a mounting means for supporting and indexing the containers;

b. placing a flexible sealing sheet over the container orifices;

c. placing a lid having rigidly-defined apertures over said containers so that the apertures correspond to the container orifices;

d. forcing the lid down upon the containers to first rigidly clamp the sheet in place and then to stretch the sheet over the orifices as the orifices enter the apertures.

22. The process of claim 21 wherein the sheet is clamped only at the perimeter of the lid.

* * * * *

UNITED STATES PATENT AND TRADEMARK OFFICE

CERTIFICATE OF CORRECTION

PATENT NO. : 4,040,234

DATED : August 9, 1977

INVENTOR(S) : Douglas P. Stockdale, et al.

It is certified that error appears in the above-identified patent and that said Letters Patent are hereby corrected as shown below:

Column 1, line 39, delete "2,582,666" and insert therefor -- 2,582,566 --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*